US010020564B2

(12) United States Patent
Hane

(10) Patent No.: US 10,020,564 B2
(45) Date of Patent: Jul. 10, 2018

(54) NEAR-FIELD WAVEGUIDE

(71) Applicants: ISSIX WORLD, INC., Tokyo (JP); BEACON Associates, Inc., Tokyo (JP)

(72) Inventor: Kunio Hane, Tokyo (JP)

(73) Assignee: ISSIX WORLD, INC., Tokyo (JP)

( * ) Notice: Subject to any disclaimer, the term of this patent is extended or adjusted under 35 U.S.C. 154(b) by 1 day.

(21) Appl. No.: 15/337,608

(22) Filed: Oct. 28, 2016

(65) Prior Publication Data

US 2017/0047646 A1 Feb. 16, 2017

Related U.S. Application Data

(63) Continuation of application No. PCT/JP2014/072863, filed on Aug. 26, 2014.

(51) Int. Cl.

| | |
|---|---|
| ***H01Q 1/24*** | (2006.01) |
| ***H01Q 1/22*** | (2006.01) |
| ***H01Q 1/38*** | (2006.01) |
| ***H01Q 13/10*** | (2006.01) |

(52) U.S. Cl.

CPC ..... *H01Q 1/245* (2013.01); *H01Q 1/2291* (2013.01); *H01Q 1/243* (2013.01); *H01Q 1/38* (2013.01); *H01Q 13/10* (2013.01)

(58) Field of Classification Search

CPC ..... H01Q 1/245; H01Q 1/2291; H01Q 1/243; H01Q 1/38; H01Q 13/10

See application file for complete search history.

(56) References Cited

U.S. PATENT DOCUMENTS 6,341,217 B1 * 1/2002 Wong ..... H01Q 1/245 379/446

2002/0030630 A1 3/2002 Maeda et al.

(Continued)

FOREIGN PATENT DOCUMENTS

JP 2001-77611 A 3/2001

JP 2002-158519 A 5/2002

(Continued)

OTHER PUBLICATIONS

International Search Report issued in PCT/JP2014/072863, dated Oct. 14, 2014, with translation (3 pages).

(Continued)

*Primary Examiner* — Dameon E Levi

*Assistant Examiner* — David Lotter

(74) *Attorney, Agent, or Firm* — Nakanishi IP Associates, LLC

(57) ABSTRACT

As the technology relating to controlling electromagnetic waves radiating from the mobile phone such as smart phone during a phone call, wide band waveguide that controls electromagnetic waves radiating from mobile phone and radiating them towards hand was invented. Distance between mobile phone, waveguide and hand is 3 to 6% of the wavelength. Hence, design in near field condition was a problem. This problem was solved by measurement and wide band near field waveguide in which metal sheet is processed was realized. The quantity of electromagnetic waves received by head is reduced to ¼-1/10 within the entire frequency band used by the mobile phone based on adding this part to the mobile phone such as smart phone.

9 Claims, 4 Drawing Sheets

(56) References Cited

U.S. PATENT DOCUMENTS

| | | | | |
|---|---|---|---|---|
| 2005/0264448 | A1* | 12/2005 | Cox | H01Q 1/085 343/700 MS |
| 2010/0019982 | A1* | 1/2010 | Washiro | H01Q 1/273 343/860 |
| 2012/0309326 | A1 | 12/2012 | Maguire | |
| 2012/0309454 | A1 | 12/2012 | Maguire | |
| 2013/0324056 | A1 | 12/2013 | Maguire | |
| 2016/0134019 | A1* | 5/2016 | Lee | H01Q 7/00 343/866 |

FOREIGN PATENT DOCUMENTS

| | | | |
|---|---|---|---|
| JP | 2003-258523 | A | 9/2003 |
| JP | 2005-117099 | A | 4/2005 |
| JP | 2010-034617 | A | 2/2010 |

OTHER PUBLICATIONS

Written Opinion of the International Searching Authority issued in PCT/JP2014/072863, dated Oct. 14, 2014 (3 pages).

* cited by examiner

NEAR-FIELD WAVEGUIDE

CROSS-REFERENCE TO RELATED APPLICATIONS

This application is based upon and claims the benefit of priority from the Japanese Patent Application No. PCT/JP2014/072863, filed Aug. 26, 2014 the entire contents of which are incorporated herein by reference.

FIELD

The present invention relates to the technology of radiating electromagnetic waves generated by the mobile phone during a phone call towards the hand holding the mobile phone and to the part that radiates electromagnetic waves into the space through hand and arm.

BACKGROUND

The frequency bandwidth of electromagnetic waves used by the mobile phone is from 700 MHz to 2.5 GHz and the wavelength is from 43 cm to 12 cm. The electromagnetic waves generated by mobile phone are radiated into the space through body after being absorbed into the body at relative permittivity of more than 80 in the shape of length or perimeter near the wavelength that easily gets resonated.

The wavelength at frequency near 1 GHz used during call is from 20 to 40 cm. The fact that perimeter of head of an adult is of the length near the wavelength and the relative permittivity is high are combined due to which majority of the electromagnetic waves radiated during the phone call when the phone is at the ear are radiated into space through the head. The wavelength is less than 20 cm at the bandwidth of more than 1.5 GHz. However, length of the part that easily gets resonated in this frequency region is selected from the structure of head and waves are radiated into the space through this part.

The electromagnetic waves radiated from head or hand and arm are received at a distant base station. This time, the physics rule that stipulates the radiation of electromagnetic waves from hand and arm to the base station is far field condition with wavelength of more than 70% namely from 14-28 cm or more and design of wireless device is generally done according to this condition.

In the dipole antenna of the part that sends and receives electromagnetic waves, two metal rods of ¼th wavelength are arranged in straight line in long axis direction and input or output are connected to one end of the 2 metal rods which is called as feeding point and the other end is connected to the earth terminal. The feeding point and earth point are on the sides near end of each of the two earth rods. The total of two metal rods becomes ½ wavelength. If transmission of dipole antenna is given as example, long axis of metal rod is taken as center and electromagnetic waves are radiated in circular shape. Here, if metal rod is arranged parallel to dipole antenna little shorter than ½ wavelength by separating about ¼ wavelength, electromagnetic waves incline towards the newly installed metal rod direction due to circular shape of radiation pattern and shows directional characteristics. This is the theory of Yagi antenna and the newly added metal rod is called as waveguide. The electricity strength of electromagnetic waves on waveguide side becomes about double. However, theory and effect of this waveguide is far field condition.

In the frequency range of 700 MHz-2.5 GHz used in mobile phone, frequency range that can be sent and received by a single dipole antenna is about 5% as against the central frequency and hence, in a single dipole antenna, only a part of bandwidth used for mobile phone is covered.

Furthermore, physics rule that stipulates the electromagnetic waves in the region where distance from antenna is less than 70% of the wavelength is near field condition and it becomes remarkably below 10%. If the distance between hand holding the mobile phone or head and the mobile phone is 1 cm, it becomes 3% at 1 GHz frequency used by the mobile phone and 6% at 2 GHz. Therefore, the part of antenna that controls electromagnetic waves between head or hand must be designed according to the near field condition.

In the technological field of wireless communication, main point is placed where electromagnetic waves fly up to the distant place. Hence, design of system containing antenna is based on the far field theory. Even in case of using waveguide to improve transmission and reception characteristics, antenna and waveguide are integrated to form an antenna system and design is done based on far field theory using waveguide as a new radiation source of electromagnetic waves. Similar is used even in mobile phones. Antenna system is used with the aim of miniaturizing tip antenna using dielectric body having low specific permittivity loss of less than 5. However, telecommunication with base station that is the target of antenna design of mobile phone is designed according to far field condition. The fact that spatial impedance of antenna is constant regardless of distance is also combined, and design of antenna of mobile phone is done according to far field condition and near field condition is ignored. According to near field condition, magnetic field and electric field generated in antenna become function of distance and design becomes complex due to major change in impedance.

Patent literature 1 relates to the part that aims at reducing radiation exposure of electromagnetic waves to head of the person using the mobile phone by installing a part that has wave directing function and reflection function that is externally attached to the mobile phone. Regardless of head and hand of the user being at a distance of about 5% of the wavelength of the electromagnetic waves used by the mobile phone, design is done by using basic theory of controlling electromagnetic waves based on the far field condition without considering this distance.

Namely, patent literature 1 focuses on distance correlation of antenna and waveguide in which shortening of spatial length by inserting a dielectric body between the antenna and waveguide to make the distance between waveguide and antenna ¼ wavelength so that waveguide can be installed at a practical distance with respect to the mobile phone is the main claim. However, this is the evidence of using design method according to far field condition. In addition, dielectric body having specific permittivity of 100 is used as the dielectric body having high specific permittivity in order to shorten the antenna distance described in detailed description having high dielectric loss to 1/10th because of which loss of electromagnetic waves becomes remarkably higher than the case of using dielectric body having specific permittivity of less than 5 that is generally used for shortening space in the antenna system. Thus, the claim has no feasibility and design theory based on far field fails.

Therefore, original design according to near field condition is an error of design method that uses theory based on far field condition.

The patent literature 2 uses antenna device that uses waveguide based on far field condition to reduce the electromagnetic waves absorption rate of the head while also achieving improvement in gain during the phone call. Therefore, this is not the design condition that considers conditions of head and hand.

The patent literature 3 is the constitution method of antenna that is used for both mobile phone communication and TV broadcast reception, in which far communication with base station and TV station is the target. This is also the antenna design theory based on far field condition which is not the design condition that takes into consideration the condition of head and hand.

The patent literature 4 relates to a mobile communicator that houses tip antenna, controls effect of the radiating electromagnetic waves on human body in which directional characteristics on the side opposite to human side can be strengthened. However, this is not the design according to far field condition that considers effect on human body.

PRIOR ART LITERATURE

Patent Literature

Patent literature 1: U.S. Pat. No. 6,341,217 B1

Patent literature 2: Japanese Unexamined Patent Application Publication 2003-258523

Patent literature 3: Japanese Unexamined Patent Application Publication 2005-117099

Patent literature 2: Japanese Unexamined Patent Application Publication 2001-77611

SUMMARY

As the method of realizing a part that directs electromagnetic waves radiating from mobile phone away from head, use of design method according to far field condition in the prior art is not correct. Currently there is no part that controls electromagnetic waves based on the design method according to far field condition that controls electromagnetic waves on human body.

The frequency bandwidth used in mobile phone is spread at lower limit between 800 MHz to 700 MHz and higher limit between 1.9 GHz to 2.2 GHz. Technically there is no passive part having wavelength characteristics that correspond to the wider bandwidth than that enters the field of vision even if using 2.5 GHz.

The part installed in the mobile phone must reduce the effect of external shape or weight of the mobile phone.

According to a first aspect of the present invention, there is provided an electromagnetic wave control metal sheet provided between a mobile phone and a hand holding the mobile phone, and electromagnetically coupled to the hand.

According to a second aspect of the present invention, there is provided an electromagnetic wave control metal sheet having a rectangular shape with a long side within a range of 50 to 80 mm and a short side within a range of 50 to 70 mm, the electromagnetic wave control metal sheet comprising two cuts, the cuts each having a shape formed by two circles and crossing two tangents shared by the two circles, the two circles each having a radius within a range of 5 to 20 mm, and a distance between centers of the two circles being within a range of 45 to 70 mm, and the two cuts crossing at an angle within a range of 45 to 90 degrees.

According to a third aspect of the present invention, there is provided a waveguide which is a rectangular conductive sheet comprising: a plurality of tear-drop cuts having sharp tips connected to one another.

According to a fourth aspect of the present invention, there is provided a waveguide comprising a rectangular conductive sheet including a plurality of cuts having a shape formed by two circles having a same radius and crossing two tangents shared by the two circles.

DETAILED DESCRIPTION

Figure 2:
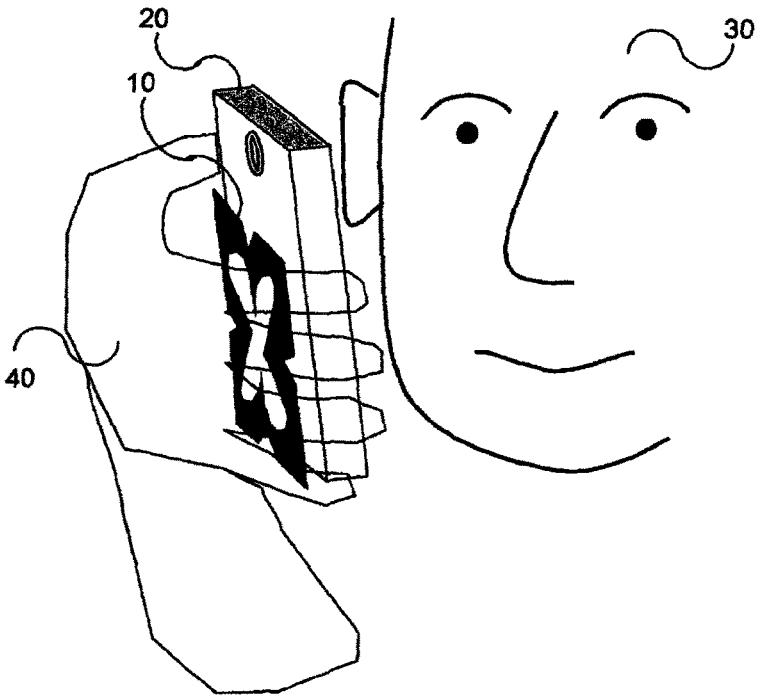
FIG. 2 shows execution method of design of wide band near field waveguide according to this embodiment.

The present invention relates to the part 10 that controls electromagnetic waves of FIG. 2, in which part 10 is combined with the mobile phone 20 to have directional characteristics for the electromagnetic waves being radiated from the mobile phone so as to avoid head of the mobile phone user and the electromagnetic waves are concentrated on hand 40 holding the phone. Thus, the part 10 has the function of a waveguide.

The mobile phone targeted by the invention is a large-screen smart phone such as iPhone or similar device used for communication. The liquid crystal side of the mobile phone is called as the front side while the opposite side is called the backside.

This part 10 is obtained by molding metal sheet having thickness of less than 0.1 mm having conductivity or film on which conductive metal is vapor deposited in the dimensions such that it can be embedded on backside of the mobile phone so that the user does not get uncomfortable feeling.

The distance of about 1 cm between the antenna used for transmission and reception of mobile phone and the head of the user or the hand holding the phone is about 3% of the wavelength of electromagnetic waves of 1 GHz and less than 70% of the wavelength is near field condition. Hence, this part forms as a near field waveguide by processing a metal sheet and designing correlation between transmission—reception antenna of mobile phone and waveguide of the present invention in near field condition without using dielectric body having high specific permittivity needed in the waveguide based on far field condition.

The frequency used of the mobile phone is 700 MHz-2.5 GHz and the shape of this part is regulated by processing metal sheet so that it has the function of wide area near field waveguide that controls the electromagnetic waves in wide band.

Size of metal sheet, antenna shape and shape of outer side are regulated so as to impart desired electromagnetic wave characteristics according to near field condition such as wide band characteristics and directional characteristics to form it as a wide band near field waveguide.

Figure 1:
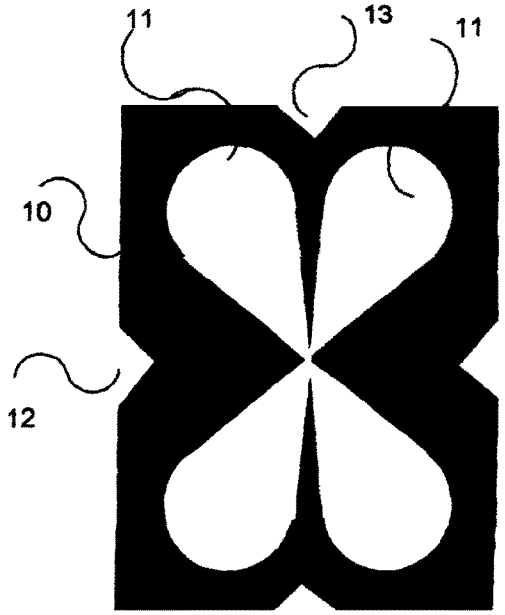
FIG. 1 shows wide band near field waveguide according to this embodiment.

This part is embedded in the middle part of the rectangular metal sheet shown in FIG. 1 by crossing 2 sets of tear-drop shaped cuts 11 acting as antenna. The tear-drop shaped cut 11 has the shape shown in FIG. 5 and it is the area surrounded by line segment crossing the two circles having distance between centers L52 of 45-70 mm and radius R51 of 5-20 mm by circumscribing these circles. If the peripheral length of the tear-drop cuts 11 is within L and R mentioned above, electromagnetic waves are controlled within the mobile phone bandwidth as a waveguide. Middle frequency of resonance is determined from size of L and R and bandwidth of frequency acting as waveguide is determined from ratio of radius R and L. If radius R is smaller than L, bandwidth becomes narrow and if excessively large, resonance does not occur. Hence, L/R is chosen between 6-9.

Length of rectangular periphery is increased by preparing cuts 12, 13 on each corner of the rectangular metal sheet to change the shape of sheet so as to regular resonance characteristics of the metal sheet with respect to electromagnetic waves.

The area expands due to formation of two tear-drop shaped cuts 11 crossing in X shape as compared to the case of forming one cut and if embedded in phone, these function as waveguide for diversity type tip antenna in which two tip antennae are placed. Angle of crossing is between 45° to 90° since position correlation of the holding hand can also be adjusted.

Figure 3:
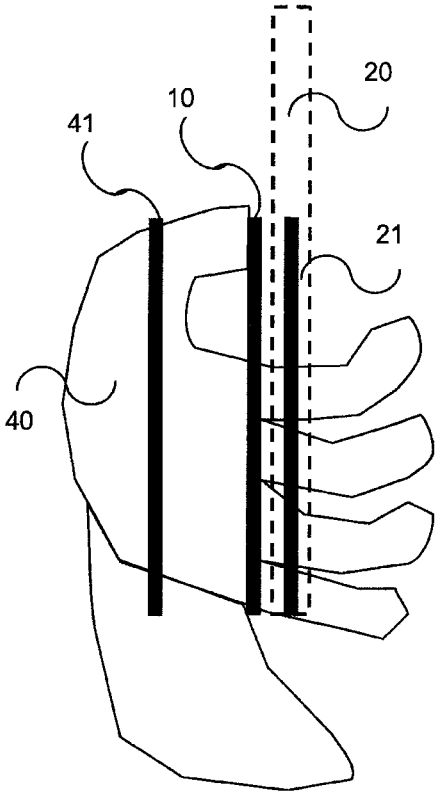
FIG. 3 shows wide band near field waveguide according to this embodiment.

Determination of shape of this part according to near field condition can be replaced with position of antenna of FIG. 3 with respect to mobile phone, this part and hand. The following measurement is performed in the arrangement of antenna according to near field condition where transmission antenna 21 embedded in mobile phone 20, this part 10 that directs electromagnetic waves and hand 40 that receives electromagnetic waves act as reception antenna 41 and distance between the transmission antenna of the mobile phone and this part is 1 mm and distance between the hand of reception antenna and part is 5-10 mm.

This part 10 is inserted between the spectrum analyzer to which wide band reception antenna 41 is connected and wide band transmission antenna 21 to which tracking generator synchronized with scanning of this frequency is connected, and frequency characteristics of transmission of frequency between the transmission and reception antennae by this part is measured. For each measurement, part is embedded with different shape and placement of tear-drop of metal sheet and different shape of outer side and effect of change in its shape is measured.

Figure 4:
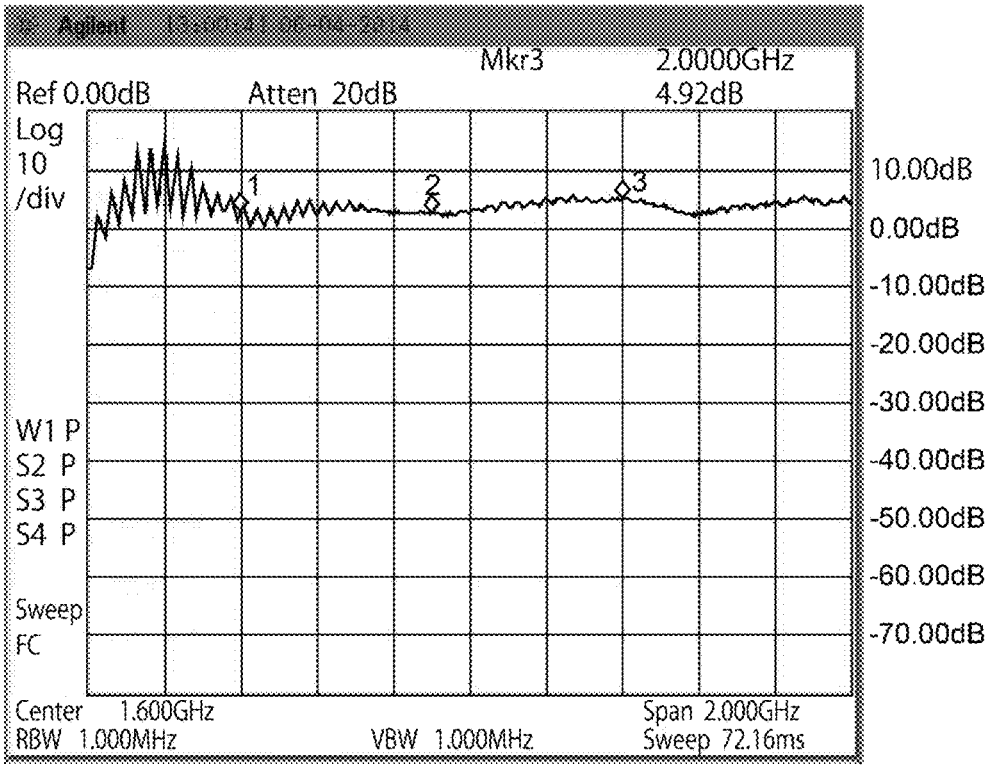
FIG. 4 is the result of measurement for wide band near field waveguide placed as antenna of FIG. 2.

FIG. 4 shows output of spectrum analyzer. Calibration of gain between the transmission and reception antennae without this part is performed beforehand. It means that it has wave direction function in which the reception antenna receives output bigger than transmission output from 0 dBm line. In the figure, this part has the wave direction function within the range from 700 MHz to 2.6 GHz and the used part solves the problem due to its shape.

The method of embedding this part in the mobile phone and controlling electromagnetic waves radiating from the mobile phone consists of pasting this part on a sheet of material having low electromagnetic waves loss in ultra high frequency region and placing the sheet on the backside of the mobile phone with this part on the inner side. Based on this, this part controls the electromagnetic waves by selecting the position opposite to in-built antenna placed below and/or beside the battery of the mobile phone and selecting lower end of mobile phone as the position that suits the operation of waveguide as the position correlation with the hand that holds the mobile phone.

As the method of embedding this part onto the mobile phone and controlling the electromagnetic waves radiating from mobile phone, pasting this part on inner or outer side of the case embedded on backside of the mobile phone using a glue or placing it on inner side of the case and inserting into backside of the mobile phone or molding in integrated manner with the case can be given as examples to control electromagnetic waves by fixing this part on most suitable position with transmission antenna of the mobile phone and hand.

The present invention reduces quantity of electromagnetic waves by ⅕ to 1/10 by radiating them into space through hand and arm using a part that directs the electromagnetic waves radiating from the mobile phone into head during a phone call to hand.

It also has a passive effect of having function of controlling electromagnetic waves without changing external appearance or shape of the phone and not losing electromagnetic waves and having no effect on the performance of the mobile phone.

Electromagnetic waves radiating from hand and arm do not have directional characteristics, they do not affect the communication between the mobile phone and base station and do not affect the performance of the mobile phone.

The wide band near field waveguide that controls electromagnetic waves radiating from the mobile phone and radiates them to the hand holding the mobile phone was realized according to near field condition.

Example of Embodiment 1

Copper foil having thickness of 16 micron meter was used as metal sheet 10 and length of short side and long side was determined within the outer dimension of the mobile phone to place it on backside of the mobile phone such as smart phone. For example, as the size that can be used in iPhone5s also, length of short side is set as 58 mm and length of long side is set as 78 mm so that it does not block the camera lens.

Figure 5:
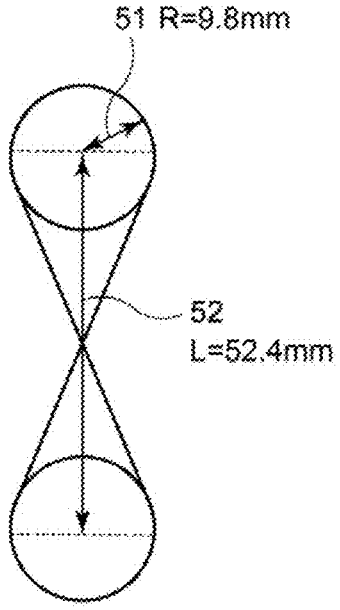
FIG. 5 shows shape of cut of tear-drop shaped antenna of waveguide according to this embodiment.

Shape of tear-drop shaped cut molded into metal sheet shape is shown in FIG. 5. Bandwidth is decided by setting the frequency of center of the used band as 1.8 GHz and UR as 7.3 by stipulating two circles having distance between centers L as 52.4 mm and radius R as 9.8 mm and length of tear-drop surrounding as the region surrounding the line circumscribing and crossing these two circles.

Two tear-drop shaped cuts 11 are formed crossing in X shape and angle formed in the center of two cuts 11 is set at 52° due to which area expands as compared to the case of forming one cut. Even in diversity type antenna in which two tip antenna are installed, these function as waveguide for each of the tip antennae and position of holding hand is adjusted.

In the center of these sides, right-angle triangular cuts 12 and 13 having depth of 6 mm in long side and 5 mm in short side are formed so as to increase peripheral length of the metal sheet and expand the frequency bandwidth to function as waveguide making the shape complex. The metal sheet molded in the abovementioned shape is inserted between the transmission antenna 21 and reception antenna 41 of FIG. 2 as the waveguide 10 and characteristics as waveguide are measured and result of examining design method mentioned above is shown in FIG. 4. Frequency is measured at frequency condition of 600 MHz to 2.6 GHz and calibration of 0 dBm is done beforehand only for transmission antenna and reception antenna. This part shows value of more than 0 dBm above 700 MHz and hence, it was confirmed that this waveguide fulfills wide band property between 700 MHz to 2.5 GHz. As a result of measurement, 10 times the electricity of electromagnetic waves radiating below 1 GHz is radiated towards reception antenna 30 namely towards hand and 2-6 times is radiated towards hand in the entire area up to 2.6

GHz. Thus, radiation to head reduces less than 1/10 below 1 GHz and between 1/2-1/6 for other frequencies.

Figure 6:
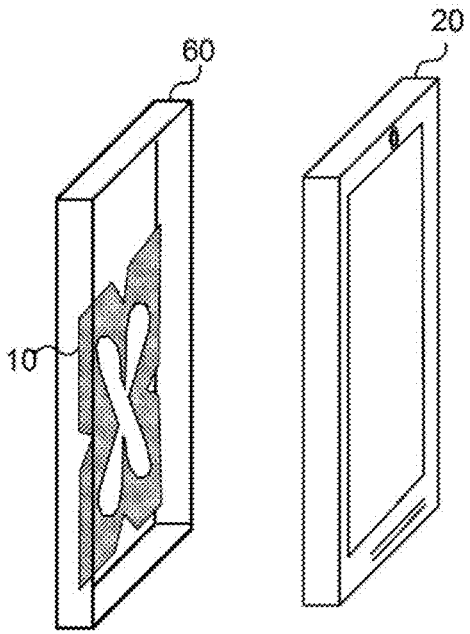
FIG. 6 is an example of embedding the part of according to this embodiment into case of the mobile phone

As shown in FIG. 6, this part made of metal sheet is pasted and held on inner side of the case 60 covering the backside of mobile phone such as smart phone so that it functions as wide band near field waveguide in the mobile phone such as smart phone and this part is placed facing the backside of the mobile phone. Based on this, most suitable position of this part according to antenna embedded inside mobile phone and hand is fixed at lower end of the mobile phone.

Example of Embodiment 2

This part 10 was pasted on outer side of case 60 covering the backside of the mobile phone such as smart phone so that it functions as wide band near field waveguide in the mobile phone such as smart phone. Thus, most suitable position of this part according to antenna embedded inside mobile phone and hand is fixed.

Example of Embodiment 3

This part was molded in integrated manner with the case 60 covering the backside of the mobile phone such as smart phone so that it functions as wide band near field waveguide in the mobile phone such as smart phone. Thus, position correlation between part embedded in mobile phone and hand was fixed by placing it facing the backside of the mobile phone.

The present invention reduces quantity of electromagnetic waves by 1/5 to 1/10 by radiating them into space through hand and arm using a part that directs the electromagnetic waves radiating from the mobile phone into head during a phone call to hand.

It also has a passive effect of having function of controlling electromagnetic waves without changing external appearance or shape of the phone and not losing electromagnetic waves and having no effect on the performance of the mobile phone.

Electromagnetic waves radiating from hand and arm do not have directional characteristics, they do not affect the communication between the mobile phone and base station and do not affect the performance of the mobile phone.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An electromagnetic wave control metal sheet provided between a mobile phone and a hand holding the mobile phone, and electromagnetically coupled to the hand, wherein:

the electromagnetic wave control metal sheet has a rectangular shape with a long side within a range of 50 to 80 mm and a short side within a range of 50 to 70 mm; the electromagnetic wave control metal sheet comprises two cuts, each of the cuts has a shape formed by two circles and crossing two tangents shared by the two circles, each of the two circles has a radius within a range of 5 to 20 mm, and a distance between centers of the two circles being within a range of 45 to 70 mm, and the two cuts cross at an angle within a range of 45 to 90 degrees.

2. The electromagnetic wave control metal sheet according to claim 1, the electromagnetic wave control metal sheet being configured to control electromagnetic waves in a near field.

3. The electromagnetic wave control metal sheet according to claim 1, the electromagnetic wave control metal sheet being configured to be attached to an inside or an outside of a case that protects a backside of the mobile phone, or being formed integrally with the case.

4. A waveguide provided between a mobile phone and a hand holding the mobile phone, and electromagnetically coupled to the hand comprising, a rectangular conductive sheet including at least one cut having a shape formed by two circles having a same radius and crossing two tangents shared by the two circles.

5. The waveguide according to claim 4, wherein the cuts cross at an angle within a range of 45 to 90 degrees.

6. The waveguide according to claim 4, comprising a plurality of notches formed around the conductive sheet.

7. The waveguide according to claim 4, wherein a ratio of a distance between centers of the two circles to the radius of the two circles is 6 to 9.

8. The waveguide according to claim 7, wherein the distance between the centers is within a range of 45 to 70 mm.

9. The waveguide according to claim 7, wherein the radius is within a range of 5 to 20 mm.

* * * * *